United States Patent [19]

Marti

[11] 4,228,812

[45] Oct. 21, 1980

[54] COIN SORTER WITH STRIKER MEANS TO PROPEL NON-STANDARD SIZE COINS

[75] Inventor: Karl Marti, Zofingen, Switzerland

[73] Assignee: PREMA GmbH, Zofingen, Switzerland

[21] Appl. No.: 969,168

[22] Filed: Dec. 13, 1978

[30] Foreign Application Priority Data

Dec. 22, 1977 [CH] Switzerland ..... 15912/77

[51] Int. Cl.[3] ..... G07D 3/12

[52] U.S. Cl. ..... 133/3 F

[58] Field of Search ..... 133/3 R, 3 C, 3 D, 3 H, 133/8 R, 8 E, 3 F

[56] References Cited

U.S. PATENT DOCUMENTS

| | | | |
|---|---|---|---|
| 3,009,555 | 11/1961 | Seckula, Sr. | 133/3 R |
| 3,026,982 | 3/1962 | Buchholz et al. | 133/3 R |
| 3,040,858 | 6/1962 | Almquist | 133/3 R |

FOREIGN PATENT DOCUMENTS 1499551 12/1970 Fed. Rep. of Germany .

*Primary Examiner*—Stanley H. Tollberg

*Attorney, Agent, or Firm*—Salter & Michaelson

[57] ABSTRACT

A coin-sorting machine designed to separate non-standard coins, e.g., foreign currency, from standard coins of the national currency to be sorted, and to collect these non-standard coins in a special tray, comprises a plurality of feeler levers, each disposed adjacent to respective detectors intended to sort the standard coins and each controlling an associated thrust member. The standard coins are deflected into respective sorting receptacles, while each non-standard coin is struck in the middle by one of the thrust members and flung over the mouths of the sorting receptacles into the special tray. Each thrust member associated with a feeler lever may be made in one piece with an ejector associated with the preceding detector and take the form of an ejecting nose contiguous with a deflector surface of that ejector.

4 Claims, 4 Drawing Figures

COIN SORTER WITH STRIKER MEANS TO PROPEL NON-STANDARD SIZE COINS

This invention relates to coin-sorting machines, and particularly to a coin sorter of the type wherein coins lying against an inclined plate travel on a track past a plurality of sorting stations, each of which includes a detector having an actuating surface and an ejector associated with and following the detector along the route travelled by the coins, each ejector being controlled by the associated detector and including a deflector surface facing the detector.

Coin sorters of this type have already been proposed. They make it possible to convey coins of a certain currency (standard coins) having different diameters into respective receptacles, so that only coins of the same diameter are collected in any one of these receptacles.

One drawback of these prior art coin sorters is the way in which they deal with non-standard coins or coin-like pieces, such as foreign currency, subway tokens, commemorative medals, or the like. When the diameter of such non-standard coins is between the diameters of two standard coins, i.e., between the respective spacing limits of two adjacent detectors, such non-standard coins land in the receptacles which are actually intended for standard coins of a smaller diameter. These non-standard coins must consequently always be sorted out of the receptacles by hand.

It is an object of this invention to provide an improved coin sorter of the aforementioned type which makes it possible to sort out non-standard coins, i.e., those whose diameters do not correspond to the adjustment of the detectors, and to convey them into a separate receptacle.

To this end, in the coin sorter according to the present invention, the improvement comprises a pivotable feeler lever disposed after each detector along the route travelled by the coins and including a feeler-surface, and a thrust member associated with and following each feeler lever along the aforementioned route and controlled by the associated feeler lever for assuming either a rest position wherein the thrust member is situated behind the plate or an operative position wherein the thrust member protrudes into the path of travel of the coins, each successive feeler-surface being situated at a predetermined distance from the associated feeler lever as a function of the rate of travel of the coins, whereby a movement of a thrust member from its rest position into its operative position as controlled by the associated feeler lever causes the thrust member to strike one of the coins substantially in the center thereof.

In a preferred embodiment of the invention, the thrust member associated with a feeler lever is made in one piece with the ejector associated with the preceding detector, this thrust member taking the form of an ejecting nose contiguous with the deflector surface of that ejector.

This preferred embodiment will now be described in detail with reference to the accompanying drawings, in which.

Figure 1:
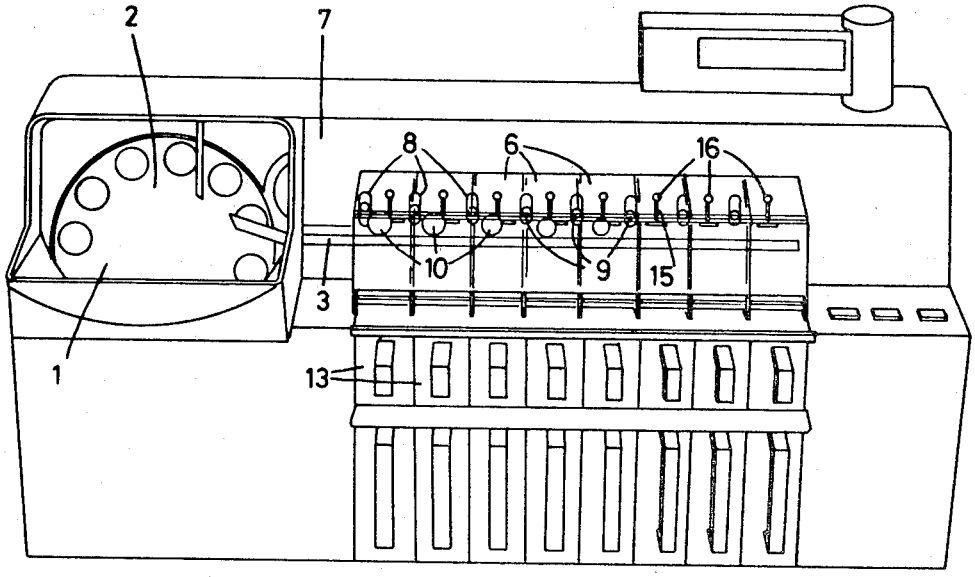
FIG. 1 is a diagrammatic perspective view of the coin sorter as a whole.
Figure 2:
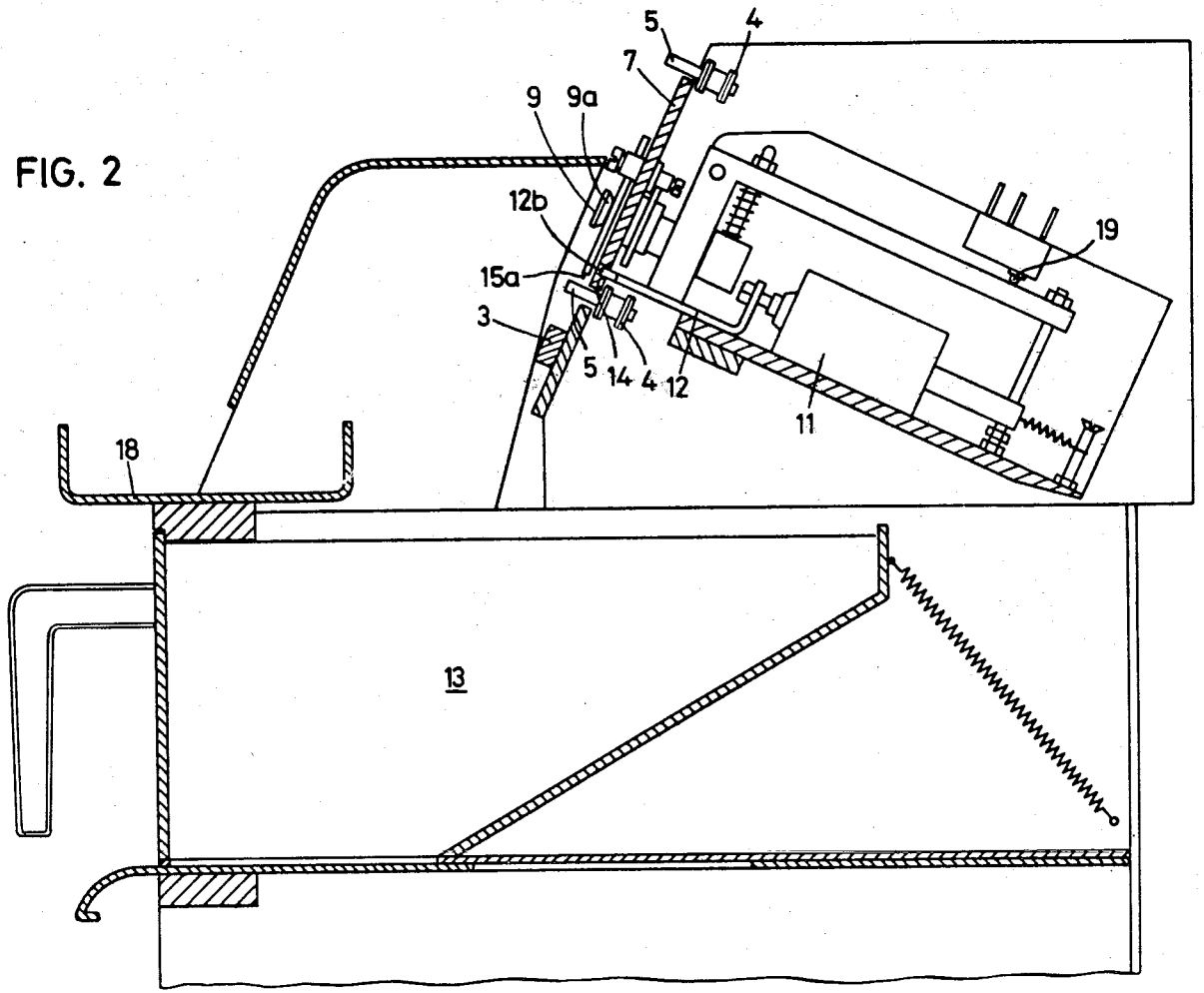
FIG. 2 is a vertical section on a larger scale.

The coin sorter in the illustrated embodiment comprises a hopper 1 for the unsorted coins. From hopper 1, the individual coins pass through a conveyor disk 2 onto a track 3 and into the area of a conveyor chain 4 (not completely shown); by means of projecting joint bolts 5 of chain 4, the coins are carried along to individual sorting stations 6. Each sorting station 6 comprises a projecting detector 9 having an actuating surface **9*a*, each such detector 9 passing through a respective aperture 8 in a guide plate 7. Each detector 9 is adjusted in such a way that the space between its actuating surface 9*a* and track 3 is slightly less than the diameter of a standard coin 10 to be sorted out. This space decreases from one detector 9 to the next along the route travelled by the coins. In a manner known per se, the coins to be sorted out displace the detectors 9 associated with their respective diameters. Each such displacement of a detector 9 closes the circuit of an electromagnetic device 11, causing an ejector 12 associated with that detector to move forward through a slot 14 in plate 7 into the path of the coins, so that coins 10 run up on a ramp-like deflector surface 12*a* of the respective ejector 12 and fall off track 3 into an open receptacle 13 associated with this ejector 12. The connection to a contact stud 19 is thereupon interrupted, causing, in a manner not shown in detail, not only the dropping-out of electromagnetic device 11** but also the actuation of a totalizing counter (not shown). Up to this point, the embodiment illustrated corresponds in all respects to prior art coin sorters.

However, the present embodiment further comprises a plurality of feeler levers 15, each disposed between two adjacent detectors 9. Feeler levers 15 take the form of rocking levers pivotable about respective axes 16 disposed at right angles to track 3. The free end of each feeler lever 15, facing track 3, forms a feeler-surface **15*a*. Feeler levers 15 might equally well be designed as levers pivotable parallel to detectors 9**, however.

Figure 3:
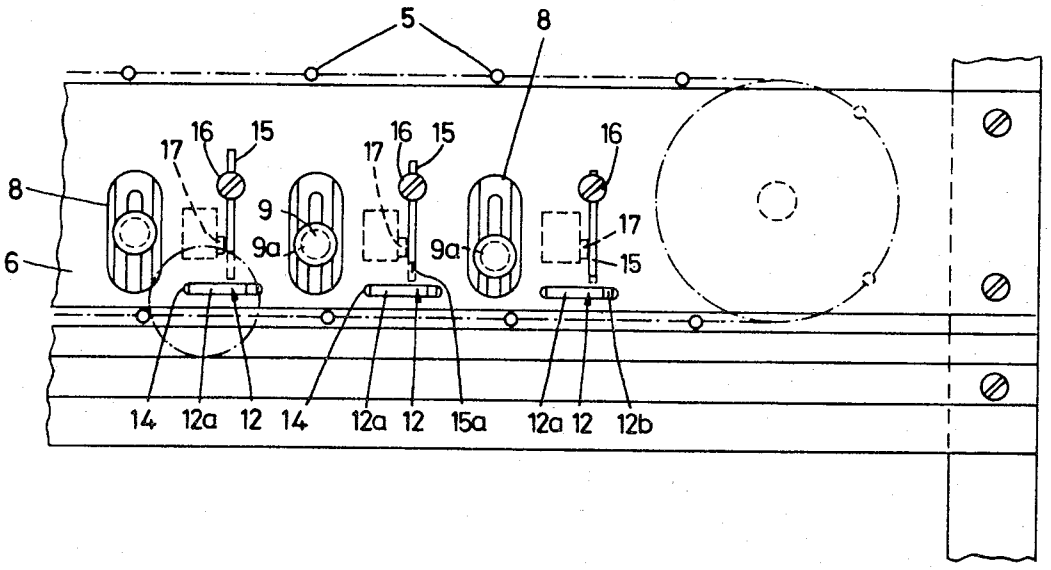
FIG. 3 is a front elevation of part of the coin sorter showing track, the detectors, and the feeler levers.
Figure 4:
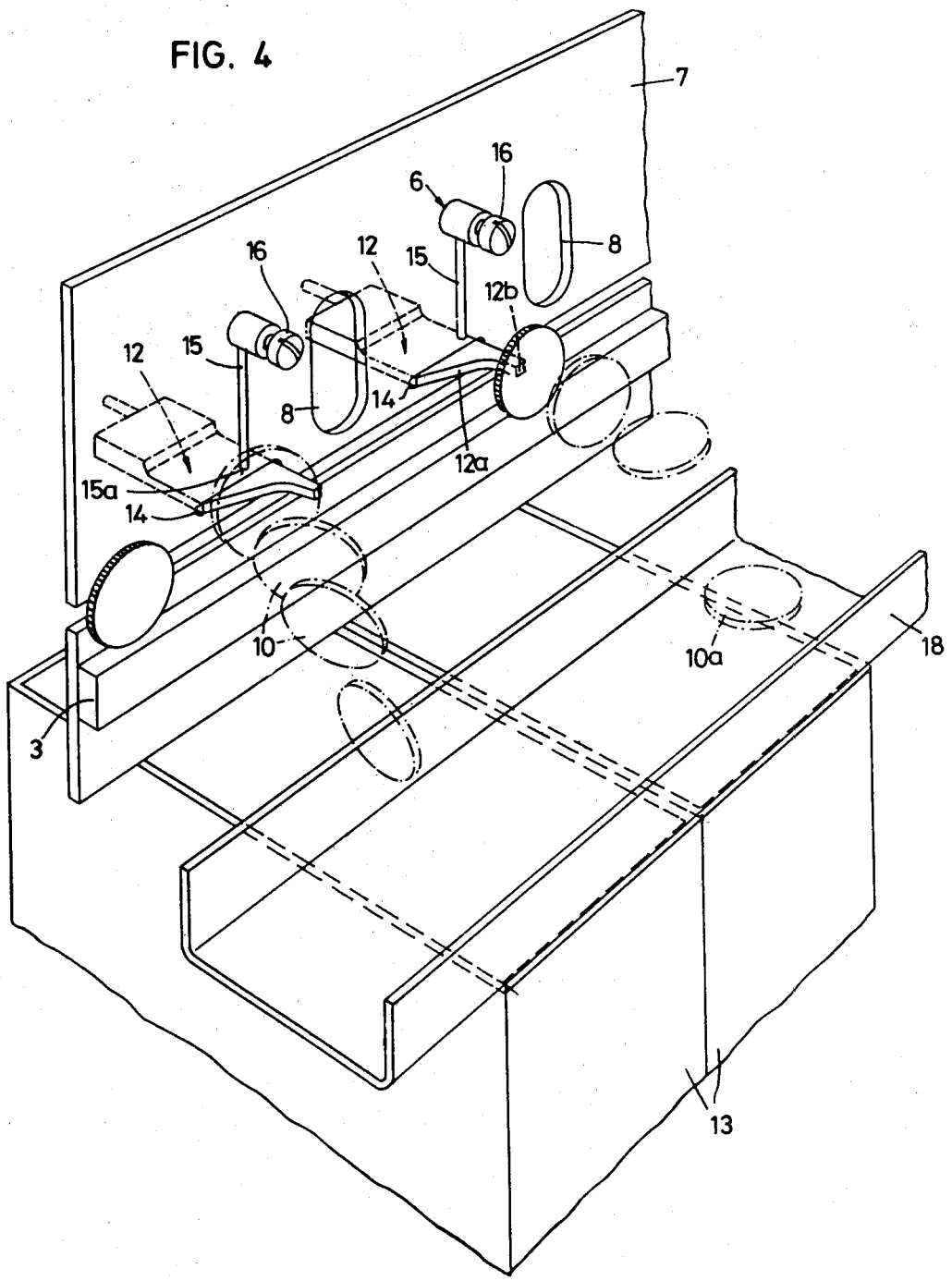
FIG. 4 is a perspective view of the same part of the coin sorter, omitting the detectors.

In the resting position shown in FIG. 3, all feeler levers 15 are held at right angles to track 3, each by a retracting spring (not shown). In this position, each lever 15 rests against a control contact 17. The arrangement is such that when the metallic connection between a feeler lever 15 and the associated control contact stud 17 is interrupted, e.g., by pivoting of lever 15, the ejector 12 associated with the preceding detector 9 is pushed forward into ejecting position.

Each ejector 12 includes an ejecting nose **12*b* contiguous with the deflector surface 12*a* thereof, at the edge thereof remote from hopper 1. Whenever an ejector 12 is actuated by the associated feeler lever 15, nose 12*b* strikes the coin which triggered the ejector movement substantially in the center of the coin so that it is not simply deflected from track 3** but is forcefully ejected as a result of the thrust imparted.

Ejected non-standard coins **10*a* are propelled by the blow received over the row of sorting receptacles 13, into which deflected standard coins 10 drop, and into a tray 18 disposed above the row of receptacles 13**.

The mode of operation of the embodiment illustrated is essentially as follows:

Assuming that the coins placed in hopper 1 include not only standard coins 10, corresponding to the adjustment of detectors 9, but also non-standard coins **10*a*, the diameters of which are between those of standard coins 10, all the coins are conveyed indiscriminately, as heretofore, onto track 3 and are carried along to sorting stations 6 by chain 4. As usual, standard coins 10 then displace the detectors 9 corresponding to their diameters, this displacement causing the respective ejectors 12 to be pushed forward into the path of the coins so that standard coins 10 run up against deflector surfaces 12***a* and fall into one of the sorting receptacles 13.

A non-standard coin 10*a*, the diameter of which lies between the spacing limits of actuating surfaces 9*a* of adjacent detectors 9 with respect to track 3, will have no effect upon the first detector 9 in the direction of advance, but will pivot the following feeler lever 15, which would not happen in the case of a standard coin 10 of smaller diameter. This pivoting movement causes the ejector 12 situated between the two detectors 9 to move forward, this movement being triggered later than if it had been caused by displacement of the preceding detector 9. As a result, when ejector 12 moves forward, the non-standard coin 10*a* is not just about to reach that ejector, as a standard coin would be, but is already level with that ejector. Thus, whereas a standard coin 10 will run up on deflector surface 12*a* in the course of its advance by chain 4 and will be guided into the proper receptacle 13, the non-standard coin 10*a* will be struck in the middle by nose 12*b* of ejector 12, so that coin 10*a*, instead of being deflected, will be flung away. The blow is struck with such force that non-standard coin 10*a* can no longer fall into the receptacle 13 associated with the preceding detector 9 but flies over the mouth of that receptacle into tray 18.

Non-standard coins 10*a* are thereby prevented from landing in receptacles 13 intended solely for standard coins 10 and are collected instead in tray 18.

Since counting is effected solely by displacements of detectors 9, which are not involved in the ejection of non-standard coins 10*a*, the latter are not included in the count.

In other possible embodiments, the counting pulses might be supplied by ejectors 12, i.e., by electromagnetic devices 11 controlling them. In this case, an electric circuit may be provided for interrupting the count upon pivoting of a feeler lever 15.

In any case, it is possible to collect non-standard coins 10*a*, i.e., such as do not correspond in diameter to any standard coin 10, in a special tray 18 instead of having them end up in the receptacles 13 intended for standard coins 10 and be counted along with the latter.

It will be obvious to those skilled in the art that the embodiment described might also be varied in a number of different ways.

If there is any danger that there might be non-standard coins of a larger diameter than any of the standard coins, it will be expedient to provide an additional feeler lever situated before the first detector along the route travelled by the coins. This additional feeler lever will have its own associated thrust member, which need have no deflector surface.

Furthermore, thrust members and ejectors might be designated as separate and independent elements, each of which would have its own associated electromagnetic device, the latter preferably being disposed one above the other.

What is claimed is:

1. In a coin sorter of the type wherein coins lying against an inclined plate travel on a track past a plurality of sorting stations, each of which includes a detector having an actuating surface and an ejector associated with and following said detector along the route travelled by said coins, each said ejector being controlled by the associated said detector and including a deflector surface facing said detector, whereby when said ejector is moved to operative position by its associated detector, the coin located at said station is caused to ride along said deflector surface off of said track whereby it drops by gravity into collecting means located beneath the associated station, the improvement which comprises:

A pivotable feeler lever disposed after each said detector along said route and including a feeler-surface and a thrust member associated with and following each said feeler lever along said route and controlled by the associated said feeler lever for assuming either a rest position wherein said thrust member is situated behind said plate or an operative position wherein said thrust member protrudes into the path of travel of said coins, each successive said feeler-surface being situated at a lower level with respect to said track than that of the preceding said feeler-surface, and each said thrust member being situated at a predetermined distance from the associated said feeler lever as a function of the rate of travel of said coins, whereby a movement of a said thrust member from said rest position into said operative position as controlled by the associated said feeler lever causes said thrust member to sharply strike one of said coins substantially in the center thereof to propel said coin over the top of said collection means for receipt by a separate receptable.

2. The coin sorter of claim 1 wherein each said feeler lever is pivotable about an axis disposed at right angles to said inclined plate, said feeler-surface of each of said feeler-lever being situated at an end of said feeler lever facing said track.

3. The coin sorter of claim 1 wherein each said thrust member associated with a said feeler lever is made in one piece with the said ejector associated with the preceding said detector.

4. In a coin sorter of the type wherein coins lying against an inclined plate travel on a track past a plurality of sorting stations, each of which includes a detector having an actuating surface and an ejector associated with and following said detector along the route travelled by said coins, each said ejector being controlled by the associated said detector and including a deflector surface facing said detector, the improvement which comprises:

a pivotable feeler lever disposed after each said detector along said route and including a feeler-surface and a thrust member associated with and following each said feeler lever along said route and controlled by the associated said feeler lever for assuming either a rest position wherein said thrust member is situated behind said plate or an operative position wherein said thrust member protrudes into the path of travel of said coins, each successive said feeler-surface being situated at a lower level with respect to said track than that of the preceding said feeler-surface, and each said thrust member being situated at a predetermined distance from the associated said feeler lever as a function of the rate of travel of said coins, whereby a movement of a said thrust member from said rest position into said operative position as controlled by the associated said feeler lever causes said thrust member to strike one of said coins substantially in the center thereof, each said thrust member associated with a said feeler lever being made in one piece with said ejector associated with the preceding said detector, said thrust member taking the form of an ejecting nose contiguous with said deflector surface of said ejector and remote from the preceding said detector.

* * * * *